US008622155B2

(12) United States Patent
Hall et al.

(10) Patent No.: US 8,622,155 B2
(45) Date of Patent: Jan. 7, 2014

(54) POINTED DIAMOND WORKING ENDS ON A SHEAR BIT

(75) Inventors: David R. Hall, Provo, UT (US); Ronald B. Crockett, Payson, UT (US); John Bailey, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 272 days.

(21) Appl. No.: 11/829,577

(22) Filed: Jul. 27, 2007

(65) Prior Publication Data

US 2008/0035380 A1 Feb. 14, 2008

Related U.S. Application Data

(63) Continuation-in-part of application No. 11/766,975, filed on Jun. 22, 2007, now Pat. No. 8,122,980, and a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, application No. 11/829,577, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21B 10/43* (2006.01)

(52) U.S. Cl.
USPC ..... 175/431

(58) Field of Classification Search
USPC ..... 175/431, 434, 428
See application file for complete search history.

(56) References Cited

U.S. PATENT DOCUMENTS 616,118 A 12/1889 Kunhe
465,103 A 12/1891 Wegner (Continued)

OTHER PUBLICATIONS

Hartman, et al. SME Mining Engineerign Handbook, pp. 891, 892. 1993.*

(Continued)

*Primary Examiner* — John Kreck
(74) *Attorney, Agent, or Firm* — Osha Liang LLP

(57) ABSTRACT

In one aspect of the present invention, a drill string has a drill bit with a body intermediate a shank and a working face. The working face has a plurality of blades converging at a center of the working surface and diverging towards a gauge of the working face. At least one blade has a cutting element with a carbide substrate bonded to a diamond working end with a pointed geometry. The diamond working end also has a central axis which intersects an apex of the pointed geometry. The axis is oriented between a 25 and 85 degree positive rake angle.

14 Claims, 12 Drawing Sheets

(56) References Cited

U.S. PATENT DOCUMENTS

| | | | | |
|---|---|---|---|---|
| 946,060 | A | | 1/1910 | Looker |
| 1,116,154 | A | | 11/1914 | Stowers |
| 1,183,630 | A | | 5/1916 | Bryson |
| 1,189,560 | A | | 7/1916 | Gondos |
| 1,360,908 | A | | 11/1920 | Everson |
| 1,387,733 | A | | 8/1921 | Midgett |
| 1,460,671 | A | | 7/1923 | Hebsacker |
| 1,544,757 | A | | 7/1925 | Hufford |
| 2,169,223 | A | | 8/1931 | Christian |
| 1,821,474 | A | | 9/1931 | Mercer |
| 1,879,177 | A | | 9/1932 | Gault |
| 2,004,315 | A | | 6/1935 | Fean |
| 2,054,255 | A | | 9/1936 | Howard |
| 2,064,255 | A | | 12/1936 | Garfield |
| 2,121,202 | A | | 6/1938 | Killgore |
| 2,124,438 | A | | 7/1938 | Struk et al. |
| 2,218,130 | A | | 10/1940 | Court |
| 2,320,136 | A | | 5/1943 | Kammerer |
| 2,466,991 | A | | 4/1949 | Kammerer |
| 2,540,464 | A | | 2/1951 | Stokes |
| 2,544,036 | A | | 3/1951 | Kammerer |
| 2,755,071 | A | | 7/1956 | Kammerer |
| 2,776,819 | A | | 1/1957 | Brown |
| 2,819,043 | A | | 1/1958 | Henderson |
| 2,838,284 | A | | 6/1958 | Austin |
| 2,894,722 | A | | 7/1959 | Buttolph |
| 2,901,223 | A | | 8/1959 | Scott |
| 2,963,102 | A | | 12/1960 | Smith |
| 3,135,341 | A | | 6/1964 | Ritter |
| 3,254,392 | A | | 6/1966 | Novkov |
| 3,294,186 | A | | 12/1966 | Buell |
| 3,379,264 | A | | 4/1968 | Cox |
| 3,397,012 | A | | 8/1968 | Krekeler |
| 3,429,390 | A | | 2/1969 | Bennett |
| 3,493,165 | A | | 2/1970 | Schonfeld |
| 3,583,504 | A | | 6/1971 | Aalund |
| 3,626,775 | A | | 12/1971 | Gentry |
| 3,745,396 | A | | 7/1973 | Quintal et al. |
| 3,745,623 | A | | 7/1973 | Wentorf, Jr. et al. |
| 3,746,396 | A | | 7/1973 | Radd |
| 3,764,493 | A | | 10/1973 | Rosar et al. |
| 3,800,891 | A | | 4/1974 | White et al. |
| 3,807,804 | A | | 4/1974 | Kniff |
| 3,821,993 | A | * | 7/1974 | Kniff ..... 175/292 |
| 3,830,321 | A | | 8/1974 | McKenry et al. |
| 3,932,952 | A | | 1/1976 | Helton |
| 3,945,681 | A | | 3/1976 | White |
| 3,955,635 | A | | 5/1976 | Skidmore |
| 3,960,223 | A | | 6/1976 | Kleine |
| 4,005,914 | A | | 2/1977 | Newman |
| 4,006,936 | A | | 2/1977 | Crabiel |
| 4,081,042 | A | | 3/1978 | Johnson |
| 4,096,917 | A | | 6/1978 | Harris |
| 4,098,362 | A | | 7/1978 | Bonnice |
| 4,106,577 | A | | 8/1978 | Summer |
| 4,109,737 | A | | 8/1978 | Bovenkerk |
| 4,140,004 | A | | 2/1979 | Smith et al. |
| 4,156,329 | A | | 5/1979 | Daniels et al. |
| 4,176,723 | A | | 12/1979 | Arceneaux |
| 4,199,035 | A | | 4/1980 | Thompson |
| 4,201,421 | A | | 5/1980 | Den Besten |
| 4,211,508 | A | | 7/1980 | Dill et al. |
| 4,224,380 | A | | 9/1980 | Bovenkerk et al. |
| 4,253,533 | A | | 3/1981 | Baker |
| 4,268,089 | A | | 5/1981 | Spence et al. |
| 4,277,106 | A | | 7/1981 | Sahley |
| 4,280,573 | A | | 7/1981 | Sudnishnikov |
| 4,304,312 | A | | 12/1981 | Larsson |
| 4,307,786 | A | | 12/1981 | Evans |
| D264,217 | S | | 5/1982 | Prause et al. |
| 4,333,902 | A | | 6/1982 | Hara |
| 4,333,986 | A | | 6/1982 | Tsuji et al. |
| 4,337,980 | A | | 7/1982 | Krekeler |
| 4,390,992 | A | | 6/1983 | Judd |
| 4,397,361 | A | | 8/1983 | Langford |
| 4,412,980 | A | | 11/1983 | Tsuji et al. |
| 4,416,339 | A | | 11/1983 | Baker |
| 4,425,315 | A | | 1/1984 | Tsuji et al. |
| 4,439,250 | A | | 3/1984 | Acharya et al. |
| 4,445,580 | A | | 5/1984 | Sahley |
| 4,448,269 | A | | 5/1984 | Ishikawa |
| 4,465,221 | A | | 8/1984 | Schmidt |
| 4,481,016 | A | | 11/1984 | Campbell et al. |
| 4,484,644 | A | | 11/1984 | Cook et al. |
| 4,484,783 | A | | 11/1984 | Emmerich |
| 4,489,986 | A | | 12/1984 | Dziak |
| 4,499,795 | A | | 2/1985 | Radtke |
| 4,525,178 | A | | 6/1985 | Hall |
| 4,531,592 | A | | 7/1985 | Hayatdavoudi |
| 4,535,853 | A | | 8/1985 | Ippolito |
| 4,538,691 | A | | 9/1985 | Dennis |
| 4,566,545 | A | | 1/1986 | Story |
| 4,574,895 | A | | 3/1986 | Dolezal |
| 4,599,731 | A | | 7/1986 | Ware et al. |
| 4,604,106 | A | | 8/1986 | Hall |
| 4,627,503 | A | | 12/1986 | Horton |
| 4,636,253 | A | | 1/1987 | Nakai et al. |
| 4,636,353 | A | | 1/1987 | Seon |
| 4,640,374 | A | | 2/1987 | Dennis |
| 4,647,111 | A | | 3/1987 | Bronder et al. |
| 4,647,546 | A | | 3/1987 | Hall, Jr. et al. |
| 4,650,776 | A | | 3/1987 | Cerceau et al. |
| 4,662,348 | A | | 5/1987 | Hall et al. |
| 4,664,705 | A | | 5/1987 | Horton et al. |
| 4,678,237 | A | | 7/1987 | Collin |
| 4,682,987 | A | | 7/1987 | Brady et al. |
| 4,684,176 | A | | 8/1987 | Den Besten et al. |
| 4,688,856 | A | | 8/1987 | Elfgen |
| 4,690,691 | A | | 9/1987 | Komanduri |
| 4,694,918 | A | | 9/1987 | Hall |
| 4,725,098 | A | | 2/1988 | Beach |
| 4,726,718 | A | | 2/1988 | Meskin et al. |
| 4,729,440 | A | | 3/1988 | Hall |
| 4,729,441 | A | | 3/1988 | Peetz et al. |
| 4,729,603 | A | | 3/1988 | Elfgen |
| 4,765,419 | A | | 8/1988 | Scholz et al. |
| 4,765,686 | A | | 8/1988 | Adams |
| 4,765,687 | A | | 8/1988 | Parrott |
| 4,776,862 | A | | 10/1988 | Wiand |
| 4,815,342 | A | | 3/1989 | Brett et al. |
| 4,852,672 | A | | 8/1989 | Behrens |
| 4,880,154 | A | | 11/1989 | Tank |
| 4,889,017 | A | | 12/1989 | Fuller |
| D305,871 | S | | 2/1990 | Geiger |
| 4,921,310 | A | | 5/1990 | Hedlund et al. |
| 4,932,723 | A | | 6/1990 | Mills |
| 4,940,099 | A | | 7/1990 | Deane et al. |
| 4,940,288 | A | | 7/1990 | Stiffler et al. |
| 4,944,559 | A | | 7/1990 | Sionnet et al. |
| 4,944,772 | A | | 7/1990 | Cho |
| 4,951,762 | A | | 8/1990 | Lundell |
| 4,956,238 | A | | 9/1990 | Griffin |
| 4,962,822 | A | | 10/1990 | Pascale |
| 4,981,184 | A | | 1/1991 | Knowlton |
| 5,007,685 | A | | 4/1991 | Beach et al. |
| 5,009,273 | A | | 4/1991 | Grabinski |
| 5,011,515 | A | | 4/1991 | Frushour |
| 5,027,914 | A | | 7/1991 | Wilson |
| 5,038,873 | A | | 8/1991 | Jurgens |
| D324,056 | S | | 2/1992 | Frazee |
| D324,226 | S | | 2/1992 | Frazee |
| 5,088,797 | A | | 2/1992 | O'Neill |
| 5,112,165 | A | | 5/1992 | Hedlund et al. |
| 5,119,714 | A | | 6/1992 | Scott et al. |
| 5,119,892 | A | | 6/1992 | Clegg |
| 5,141,063 | A | | 8/1992 | Quesenbury |
| 5,141,289 | A | | 8/1992 | Stiffler |
| D329,809 | S | | 9/1992 | Bloomfield |
| 5,154,245 | A | | 10/1992 | Waldenstrom |
| 5,186,268 | A | | 2/1993 | Clegg |
| 5,186,892 | A | | 2/1993 | Pope |
| 5,222,566 | A | | 6/1993 | Taylor |
| 5,248,006 | A | | 9/1993 | Scott et al. |
| 5,251,964 | A | | 10/1993 | Ojanen |

(56) References Cited

U.S. PATENT DOCUMENTS 5,255,749 A 10/1993 Bumpurs
5,261,499 A 11/1993 Grubb
5,265,682 A 11/1993 Russell
D342,268 S 12/1993 Meyer
5,303,984 A 4/1994 Ojanen
5,304,342 A 4/1994 Hall, Jr. et al.
5,332,051 A * 7/1994 Knowlton ..... 175/430
5,332,348 A 7/1994 Lemelson
5,351,770 A 10/1994 Cawthorne et al.
5,361,859 A 11/1994 Tibbitts
5,374,319 A 12/1994 Stueber et al.
D357,485 S 4/1995 Mattson et al.
5,410,303 A 4/1995 Comeau
5,417,292 A 5/1995 Polakoff
5,417,475 A 5/1995 Graham et al.
5,423,389 A 6/1995 Warren
5,447,208 A 9/1995 Lund
5,494,477 A 2/1996 Flood et al.
5,507,357 A 4/1996 Hult
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers
5,653,300 A 8/1997 Lund
5,655,614 A 8/1997 Azar
5,662,720 A 9/1997 O'Tigheamaigh
5,678,644 A 10/1997 Fielder
5,709,279 A 1/1998 Dennis
5,720,528 A 2/1998 Ritchey
5,732,784 A * 3/1998 Nelson ..... 175/385
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood et al.
5,871,060 A 2/1999 Jensen et al.
5,875,862 A 3/1999 Jurewicz
5,884,979 A 3/1999 Latham
5,890,552 A 4/1999 Scott et al.
5,896,938 A 4/1999 Moeny
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,967,250 A 10/1999 Lund
5,979,571 A 11/1999 Scott
5,992,405 A 11/1999 Sollami
5,992,547 A 11/1999 Caraway
5,992,548 A 11/1999 Silva
6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts
6,039,131 A 3/2000 Beaton
6,041,875 A 3/2000 Rai et al.
6,044,920 A 4/2000 Massa et al.
6,051,079 A 4/2000 Andersson et al.
6,056,911 A 5/2000 Griffin
6,065,552 A 5/2000 Scott et al.
6,068,913 A 5/2000 Cho et al.
6,095,262 A 8/2000 Chen
6,098,730 A 8/2000 Scott et al.
6,113,195 A 9/2000 Mercier et al.
6,131,675 A 10/2000 Anderson
6,150,822 A 11/2000 Hong
6,170,917 B1 1/2001 Heinrich et al.
6,186,251 B1 2/2001 Butcher
6,193,770 B1 2/2001 Sung
6,196,340 B1 3/2001 Jensen
6,196,636 B1 3/2001 Mills
6,196,910 B1 3/2001 Johnson
6,199,645 B1 * 3/2001 Anderson et al. ..... 175/426
6,199,956 B1 3/2001 Kammerer
6,202,761 B1 3/2001 Forney
6,213,226 B1 4/2001 Eppink
6,216,805 B1 4/2001 Lays et al.
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton
6,270,165 B1 8/2001 Peay
6,272,748 B1 8/2001 Smyth
6,290,007 B2 9/2001 Beuershausen et al.
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 11/2001 Yong et al.
6,332,503 B1 * 12/2001 Pessier et al. ..... 175/336
6,340,064 B2 1/2002 Fielder
6,341,823 B1 1/2002 Sollami
6,354,771 B1 3/2002 Bauschulte et al.
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson
6,408,052 B1 6/2002 McGeoch
6,408,959 B2 6/2002 Bertagnolli
6,412,560 B1 7/2002 Bernat
6,419,278 B1 7/2002 Cunningham
6,424,919 B1 7/2002 Moran et al.
6,429,398 B1 8/2002 Legoupil et al.
6,435,287 B2 8/2002 Estes
6,439,326 B1 8/2002 Huang
6,460,637 B1 10/2002 Siracki et al.
6,468,368 B1 10/2002 Merrick et al.
6,474,425 B1 11/2002 Truax
6,478,383 B1 11/2002 Ojanen et al.
6,481,803 B2 11/2002 Ritchey
6,484,825 B2 11/2002 Watson
6,484,826 B1 11/2002 Anderson
6,499,547 B2 12/2002 Scott et al.
6,508,318 B1 1/2003 Linden et al.
6,510,906 B1 1/2003 Richert
6,513,606 B1 2/2003 Krueger
6,516,293 B1 2/2003 Huang et al.
6,517,902 B2 2/2003 Drake et al.
6,533,050 B2 3/2003 Malloy
6,561,293 B2 5/2003 Minikus et al.
6,562,462 B2 5/2003 Griffin et al.
D477,225 S 7/2003 Pinnavaia
6,585,326 B2 7/2003 Sollami
6,592,985 B2 7/2003 Griffin et al.
6,594,881 B2 7/2003 Tibbitts
6,596,225 B1 7/2003 Pope et al.
6,601,454 B1 8/2003 Bolnan
6,601,662 B2 8/2003 Matthias et al.
6,622,803 B2 9/2003 Harvey
6,668,949 B1 12/2003 Rives
6,672,406 B2 1/2004 Beuershusen
6,685,273 B1 2/2004 Sollami
6,692,083 B2 2/2004 Latham
6,702,393 B2 3/2004 Mercier
6,709,065 B2 3/2004 Peay et al.
6,711,060 B2 3/2004 Sakakibara
6,719,074 B2 4/2004 Tsuda et al.

(56) References Cited

U.S. PATENT DOCUMENTS

| | | | | |
|---|---|---|---|---|
| 6,729,420 | B2 | 5/2004 | Mensa-Wilmot | |
| 6,732,817 | B2 | 5/2004 | Dewey | |
| 6,732,914 | B2 | 5/2004 | Cadden et al. | |
| 6,733,087 | B2 | 5/2004 | Hall et al. | |
| 6,739,327 | B2 | 5/2004 | Sollami | |
| 6,749,033 | B2 | 6/2004 | Griffin et al. | |
| 6,758,530 | B2 | 7/2004 | Sollami | |
| D494,031 | S | 8/2004 | Moore, Jr. | |
| D494,064 | S | 8/2004 | Hook | |
| 6,786,557 | B2 | 9/2004 | Montgomery, Jr. | |
| 6,802,676 | B2 | 10/2004 | Noggle | |
| 6,822,579 | B2 | 11/2004 | Goswani | |
| 6,824,225 | B2 | 11/2004 | Stiffler | |
| 6,846,045 | B2 | 1/2005 | Sollami | |
| 6,851,758 | B2 | 2/2005 | Beach | |
| 6,854,810 | B2 | 2/2005 | Montgomery, Jr. | |
| 6,861,137 | B2 | 3/2005 | Griffin et al. | |
| 6,878,447 | B2 | 4/2005 | Griffin | |
| 6,879,947 | B1 | 4/2005 | Glass | |
| 6,880,744 | B2 | 4/2005 | Noro et al. | |
| 6,889,890 | B2 | 5/2005 | Yamazaki et al. | |
| 6,929,076 | B2 | 8/2005 | Fanuel | |
| 6,933,049 | B2 | 8/2005 | Wan et al. | |
| 6,953,096 | B2 | 10/2005 | Glenhill | |
| 6,959,765 | B2 | 11/2005 | Bell | |
| 6,962,395 | B2 | 11/2005 | Mouthaan | |
| 6,966,611 | B1 | 11/2005 | Sollami | |
| 6,994,404 | B1 | 2/2006 | Sollami | |
| 7,048,081 | B2 | 5/2006 | Smith et al. | |
| 3,301,339 | A1 | 9/2006 | Pennebaker | |
| 7,104,344 | B2 | 9/2006 | Kriesels et al. | |
| 7,152,703 | B2 | 12/2006 | Meiners et al. | |
| 7,204,560 | B2 | 4/2007 | Mercier et al. | |
| 7,207,398 | B2 | 4/2007 | Runia et al. | |
| D547,652 | S | 7/2007 | Kerman et al. | |
| D560,699 | S | 1/2008 | Omi | |
| 7,350,601 | B2 | 4/2008 | Belnap et al. | |
| 7,377,341 | B2 | 5/2008 | Middlemiss et al. | |
| 7,380,888 | B2 | 6/2008 | Ojanen | |
| 7,396,086 | B1 | 7/2008 | Hall et al. | |
| 7,543,662 | B2 | 6/2009 | Belnap et al. | |
| 7,575,425 | B2 | 8/2009 | Hall et al. | |
| 7,592,077 | B2 | 9/2009 | Gates, Jr. et al. | |
| 7,665,552 | B2 | 2/2010 | Hall | |
| 7,693,695 | B2 | 4/2010 | Huang et al. | |
| 7,703,559 | B2 | 4/2010 | Shen et al. | |
| 7,730,977 | B2 | 6/2010 | Achilles | |
| 7,757,785 | B2 | 7/2010 | Zhang et al. | |
| 7,798,258 | B2 | 9/2010 | Singh et al. | |
| 2001/0004946 | A1 | 6/2001 | Jensen | |
| 2001/0040053 | A1* | 11/2001 | Beuershausen | 175/57 |
| 2002/0074851 | A1 | 6/2002 | Montgomery, Jr. | |
| 2002/0153175 | A1 | 10/2002 | Ojanen | |
| 2002/0175555 | A1 | 11/2002 | Mercier | |
| 2003/0044800 | A1 | 3/2003 | Connelly et al. | |
| 2003/0079565 | A1 | 5/2003 | Liang et al. | |
| 2003/0141350 | A1 | 7/2003 | Noro et al. | |
| 2003/0209366 | A1 | 11/2003 | McAlvain | |
| 2003/0213621 | A1 | 11/2003 | Britten | |
| 2003/0217869 | A1 | 11/2003 | Snyder et al. | |
| 2003/0234280 | A1 | 12/2003 | Cadden et al. | |
| 2004/0026132 | A1 | 2/2004 | Hall et al. | |
| 2004/0026983 | A1* | 2/2004 | McAlvain | 299/111 |
| 2004/0065484 | A1 | 4/2004 | McAlvain | |
| 2004/0155096 | A1 | 8/2004 | Zimmerman et al. | |
| 2004/0238221 | A1 | 12/2004 | Runia | |
| 2004/0256155 | A1 | 12/2004 | Kriesels | |
| 2004/0256442 | A1 | 12/2004 | Gates, Jr. | |
| 2005/0044800 | A1 | 3/2005 | Hall et al. | |
| 2005/0080595 | A1 | 4/2005 | Huang | |
| 2005/0103530 | A1 | 5/2005 | Wheeler et al. | |
| 2005/0159840 | A1 | 7/2005 | Lin et al. | |
| 2005/0173966 | A1 | 8/2005 | Mouthaan | |
| 2005/0263327 | A1 | 12/2005 | Meiners et al. | |
| 2006/0032677 | A1 | 2/2006 | Azar et al. | |
| 2006/0060391 | A1 | 3/2006 | Eyre et al. | |
| 2006/0086537 | A1* | 4/2006 | Dennis | 175/57 |
| 2006/0086540 | A1 | 4/2006 | Griffin | |
| 2006/0162969 | A1 | 7/2006 | Belnap et al. | |
| 2006/0180354 | A1 | 8/2006 | Belnap et al. | |
| 2006/0180356 | A1 | 8/2006 | Durairajan et al. | |
| 2006/0186724 | A1 | 8/2006 | Stehney | |
| 2006/0237236 | A1 | 10/2006 | Sreshta et al. | |
| 2007/0106487 | A1 | 5/2007 | Gavia et al. | |
| 2007/0193782 | A1 | 8/2007 | Fang | |
| 2007/0221408 | A1 | 9/2007 | Hall et al. | |
| 2007/0278017 | A1 | 12/2007 | Shen et al. | |
| 2008/0006448 | A1 | 1/2008 | Zhang et al. | |
| 2008/0011522 | A1 | 1/2008 | Hall et al. | |
| 2008/0053710 | A1 | 3/2008 | Moss | |
| 2008/0073126 | A1 | 3/2008 | Shen et al. | |
| 2008/0073127 | A1 | 3/2008 | Zhan et al. | |
| 2008/0142276 | A1 | 6/2008 | Griffo et al. | |
| 2008/0156544 | A1 | 7/2008 | Singh et al. | |
| 2008/0206576 | A1 | 8/2008 | Qian et al. | |
| 2009/0166091 | A1 | 7/2009 | Matthews et al. | |
| 2009/0223721 | A1 | 9/2009 | Dourfaye | |

OTHER PUBLICATIONS

G. Jeffery Hoch, Is There Room for Geothermal Energy, Innovation: America's Journal of Technology Communication, Dec. 2006/Jan. 2007, http://www.innovation-america.org/.

US Department of Energy, Geothermal Drilling Faster and Cheaper is Better, Geothermal Today, May 2000, p. 28, National Renewable Energy Laboratory Golden, Colorado.

David A. Glowka, et al., Progress in the Advanced Synthetic-Diamond Drill Bit Program, 1995.

Mark A. Taylor, The State of Geothermal Technology Part 1: Subsurface Technology, pp. 29-30, Geothermal Energy Association, Nov. 2007, Washington, D.C.

Christopher J. Durrand, Super-hard, Thick Shaped PDC Cutters for Hard Rock Drilling: Development and Test Results, Feb. 3, 2010, Geothermal Reservoir Engineering, Stanford, California.

Dan Jennejohn, Research and Development in Geothermal Exploration and Drilling, pp. 5, 18-19, Dec. 2009, Geothermal Energy Association, Washington, D.C.

* cited by examiner 200H
601H
1150
202H
201H
605H
1151

200I
603
602
202I
201 I
605 I
1201

604
200J
1300
202J
201J
605J
1200

200K
1400
202K
201K
1150
605K 200L
601L
1500
202L
201L 200M
202M
201M
1600

200N
1702
1700
1701
202N
201N 1804
200O
1802
1801
1800
202O
201O

POINTED DIAMOND WORKING ENDS ON A SHEAR BIT

CROSS REFERENCE TO RELATED APPLICATION

This application is a continuation-in-part of U.S. patent application Ser. No. 11/766,975 filed on Jun. 22, 2007 and is now U.S. Pat. No. 8,122,980 that issued on Feb. 28, 2012. This application is also a continuation-in-part of U.S. patent application Ser. No. 11/774,227 filed on Jul. 6, 2007 and is now U.S. Pat. No. 7,669,938 that issued on Mar. 2, 2010. U.S. patent application Ser. No. 11/774,227 is a continuation-in-part of U.S. patent application Ser. No. 11/773,271 filed on Jul. 3, 2007 and is now U.S. Pat. No. 7,997,661 that issued on Aug. 16, 2011. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and is now U.S. Pat. No. 7,475,948 that issued on Jan. 13, 2009. U.S. patent application Ser. No. 11/742,304 is a continuation of U.S. patent application Ser. No. 11/742,261 filed on Apr. 30, 2007 and is now U.S. Pat. No. 7,469,971 that issued on Dec. 30, 2008. U.S. patent application Ser. No. 11/742,261 is a continuation-in-part of U.S. patent application Ser. No. 11/464,008 filed on Aug. 11, 2006 and is now U.S. Pat. No. 7,338,135 that issued on Mar. 4, 2008. U.S. patent application Ser. No. 11/464,008 is a continuation-in-part of U.S. patent application Ser. No. 11/463,998 filed on Aug. 11, 2006 and is now U.S. Pat. No. 7,384,105 that issued on Jun. 10, 2008. U.S. patent application Ser. No. 11/463,998 is a continuation-in-part of U.S. patent application Ser. No. 11/463,990 filed on Aug. 11, 2006 and is now U.S. Pat. No. 7,320,505 that issued on Jan. 22, 2008. U.S. patent application Ser. No. 11/463,990 is a continuation-in-part of U.S. patent application Ser. No. 11/463,975 filed on Aug. 11, 2006 and is now U.S. Pat. No. 7,445,294 that issued on Nov. 4, 2008. U.S. patent application Ser. No. 11/463,975 is a continuation-in-part of U.S. patent application Ser. No. 11/463,962 filed on Aug. 11, 2006 and is now U.S. Pat. No. 7,413,256 that issued on Aug. 19, 2008. The present application is also a continuation-in-part of U.S. patent application Ser. No. 11/695,672 filed on Apr. 3, 2007 and is now U.S. Pat. No. 7,396,086 that issued on Jul. 8, 2008. U.S. patent application Ser. No. 11/695,672 is a continuation-in-part of U.S. patent application Ser. No. 11/686,831 filed on Mar. 15, 2007 and is now U.S. Pat. No. 7,568,770 that issued on Aug. 4, 2009. All of these applications are herein incorporated by reference for all that they contain.

FIELD

This invention relates to drill bits, specifically drill bit assemblies for use in oil, gas and geothermal drilling. More particularly, the invention relates to cutting elements in rotary drag bits comprised of a carbide substrate with a non-planar interface and an abrasion resistant layer of superhard material affixed thereto using a high pressure high temperature (HPHT) press apparatus.

BACKGROUND OF THE INVENTION

Cutting elements in rotary drag bits typically comprised a carbide substrate with a non-planar interface and an abrasion resistant layer of superhard material affixed thereto using a high-pressure/high-temperature (HPHT) press apparatus. Such cutting elements typically comprise a superhard material layer or layers formed under high temperature and pressure conditions, usually in a press apparatus designed to create such conditions, cemented to a carbide substrate containing a metal binder or catalyst such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the superhard material layer and substrate is particularly susceptible to non-shear failure modes due to inherent residual stresses.

U.S. Pat. No. 6,332,503 to Pessier et al., which is herein incorporated by reference for all that it contains, discloses an array of chisel-shaped cutting elements mounted to the face of a fixed cutter bit, each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,059,054 to Portwood et al., which is incorporated by reference for all that it contains, discloses a cutter element that balances maximum gage-keeping capabilities with minimal tensile stress induced damage to the cutter elements is disclosed.

The cutter elements of the present invention have a non-symmetrical shape and may include a more aggressive cutting profile than conventional cutter elements. In one embodiment, a cutter element is configured such that the inside angle at which its leading face intersects the wear face is less than the inside angle at which its trailing face intersects the wear face. This can also be accomplished by providing the cutter element with a relieved wear face. In another embodiment of the invention, the surfaces of the present cutter element are curvilinear and the transitions between the leading and trailing faces and the gage face are rounded, or contoured. In this embodiment, the leading transition is made sharper than the trailing transition by configuring it such that the leading transition has a smaller radius of curvature than the radius of curvature of the trailing transition. In another embodiment, the cutter element has a chamfered trailing edge such that the leading transition of the cutter element is sharper than its trailing transition. In another embodiment, the cutter element has a chamfered or contoured trailing edge in combination with a canted wear face. In still another embodiment, the cutter element includes a positive rake angle on its leading edge.

BRIEF SUMMARY OF THE INVENTION

In one aspect of the present invention, a drill string has a drill bit with a body intermediate a shank and a working face. The working face has a plurality of blades converging at a center of the working surface and diverging towards a gauge of the working face. At least one blade has a cutting element with a carbide substrate bonded to a diamond working end with a pointed geometry. The diamond working end also has a central axis which intersects an apex of the pointed geometry. The axis is oriented between a 25 and 85 degree positive rake angle. More specifically, the axis may be oriented between a 35 and 50 degree positive rake angle.

During a drilling operation, 40 to 60 percent of the cuttings produced may have a volume of 0.5 to 10 cubic centimeters. The cuttings may have a substantially wedge geometry tapering at a 5 to 30 degree angle. The apex may have a 0.050 to 0.200 inch radius and the diamond working end may have a 0.100 to 0.500 inch thickness from the apex to the non-planar interface. The carbide substrate may have a thickness of 0.200 to 1 inch from a base of the carbide substrate to the non-planar interface. The cutting element may produce a 0.100 to 0.350 inch depth of cut during a drilling operation.

The diamond working end may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The formation being drilled may comprise limestone, sandstone, granite, or combinations thereof. More particularly, the formation may comprise a Mohs hardness of 5.5 to 7.

The cutting element may comprise a length of 0.50 to 2 inches and may be rotationally isolated with respect to the drill bit. In some embodiments, the central axis of the cutting element may be tangent to a cutting path formed by the working face of the drill bit during a downhole drilling operation. In other embodiments, the central axis may be positioned at an angle relative to the cutting path. The angle of at least one cutting element on a blade may be offset from an angle of at least one cutting element on an adjacent blade. A cutting element on a blade may be oriented at a different angle than an adjacent cutting element on the same blade. At least one cutting element may be arrayed along any portion of the blade, including a cone portion, a nose portion, a flank portion, and a gauge portion. A jack element coaxial with an axis of rotation may extend out of an opening disposed in the working face.

In another aspect of the present invention, a method has the steps for forming a wellbore. A drill bit has a body intermediate a shank and a working face. The working face has a plurality of blades extending outwardly from the bit body. At least one blade has a cutting element with a carbide substrate bonded to a diamond working end with a pointed geometry. The drill bit is deployed on a drill string within a wellbore. The diamond working end is positioned adjacent a downhole formation between a 25 and 85 degree positive rake angle with respect to a central axis of the drill bit. The downhole formation is degraded with the diamond working end. The step of degrading the formation may include rotating the drill string. The drill bit may rotate at 90 to 150 RPM during a drilling operation.

In another aspect of the present invention a drill string has a drill bit with a body intermediate a shank and a working face. The working face has at least one cutting element with a carbide substrate bonded to a diamond working end with a pointed geometry at a non-planar interface. The diamond working end has a central axis which intersects an apex of the pointed geometry. The axis is oriented between a 25 and 85 degree positive rake angle.

DETAILED DESCRIPTION OF THE INVENTION AND THE PREFERRED EMBODIMENT

Figure 1:
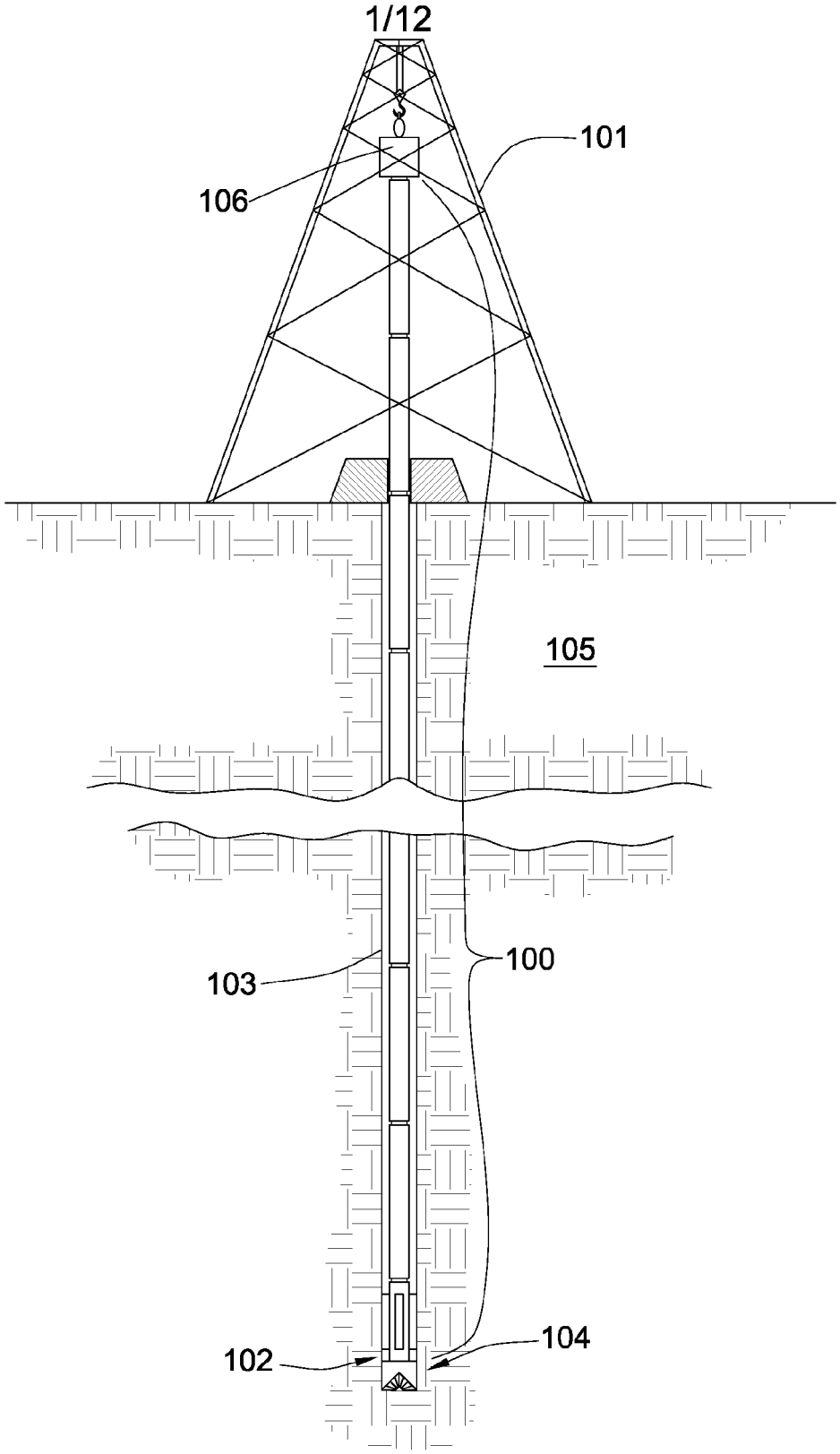
FIG. 1 is a perspective diagram of an embodiment of a drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates downhole the drill string 100 advances farther into the earth. The drill string 100 may penetrate soft or hard subterranean formations 105. The drill bit 104 may break up the formations 105 by cutting and/or chipping the formation 105 during a downhole drilling operation. The bottom hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 1A:
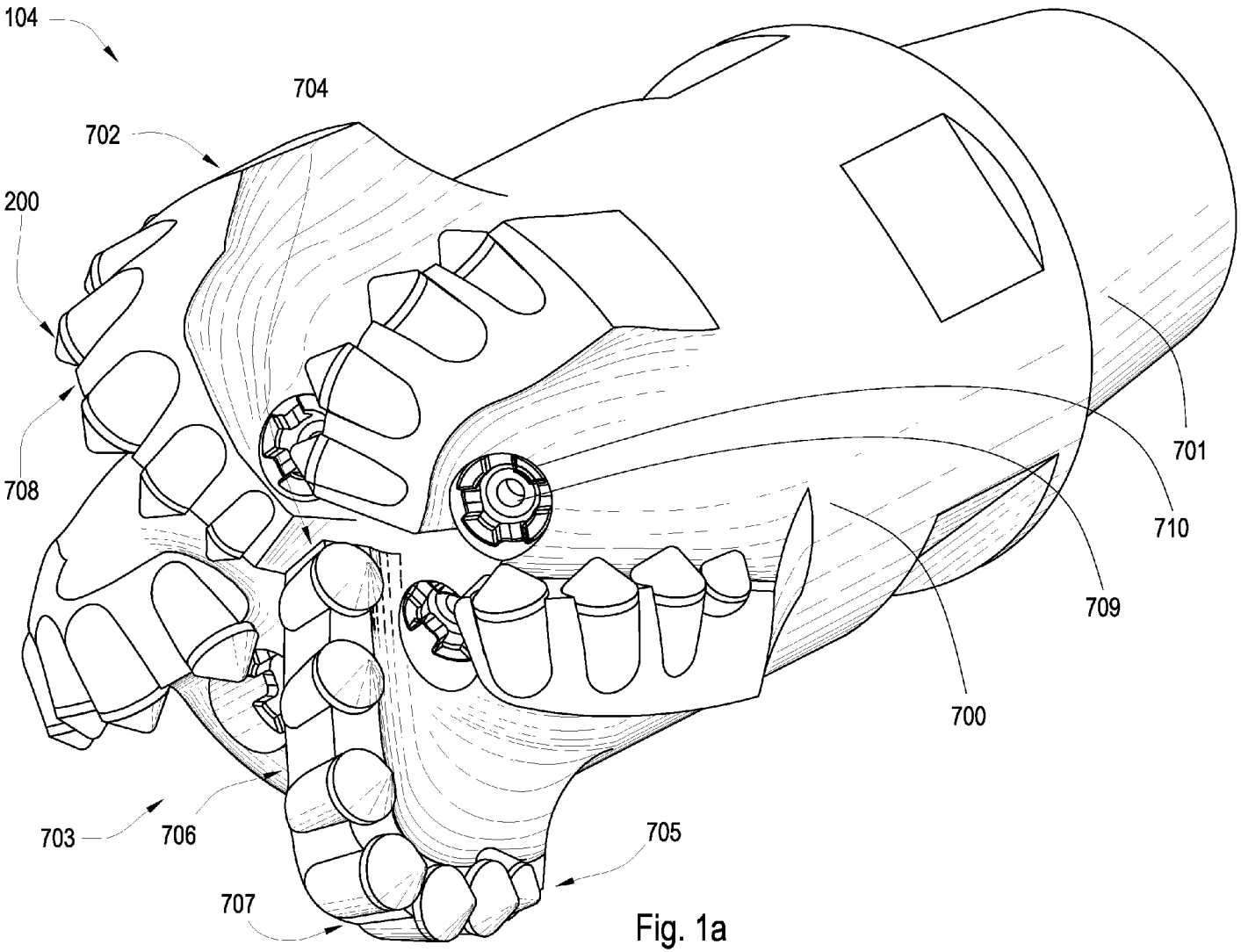
FIG. 1*a* is a perspective diagram of an embodiment of a drill bit.

In the embodiment of FIG. 1*a*, cutting elements 200 are incorporated onto a drill bit 104 having a body 700 intermediate a shank 701 and a working face 702. The shank 701 may be adapted for connection to a downhole drill string. The drill bit 104 of the present invention may be intended for deep oil and gas drilling, although any type of drilling application is anticipated such as horizontal drilling, geothermal drilling, exploration, on and off-shore drilling, directional drilling, water well drilling and any combination thereof. The working face 702 may have a plurality of blades 703 converging at a center 704 of the working face 702 and diverging towards a gauge portion 705 of the working face 702. Preferably, the drill bit 104 may have between three and seven blades 703. At least one blade 703 may have at least one cutting element 200 with a carbide substrate bonded to a diamond working end with a pointed geometry. Cutting elements 200 may be arrayed along any portion of the blades 703, including a cone portion 706, a nose portion 707, a flank portion 708, and the gauge portion 705. A plurality of nozzles 709 may be disposed into recesses 710 formed in the working face 702. Each nozzle 709 may be oriented such that a jet of drilling mud ejected from the nozzles 709 engages the formation before or after the cutting elements 200. The jets of drilling mud may also be used to clean cuttings away from the drill bit 104.

FIGS. 2 through 5 are cross-sectional diagrams of a cutting element 200A, 200B, and 200C in contact with a formation 105A, 105B, 105C, and 105D, respectively. Each cutting element 200A, 200B, and 200C has a carbide substrate 201A, 201B, and 200C, respectively, bonded to a diamond working end 202A, 202B, and 202C, respectively, that includes a pointed geometry. The diamond working end 202A 202B, and 202C has a central axis 203A, 203B, 203C which intersects an apex 204A, 204B, and 204C, respectively, of the diamond working end 202A, 202B, and 202C. A rake angle 205A, 205B, 205C is formed between the central axis 203A, 203B, 203C of the diamond working end 202A, 202B, and 202C and a vertical axis 206A, 206B, and 206C. The central axis 203A, 203B, 203C is oriented between a 25 and 85 degree positive rake angle as discussed below. In some embodiments, the central axis 203A, 203B, 203C is oriented between a 35 and 50 degree positive rake angle as discussed below.

Figure 2:
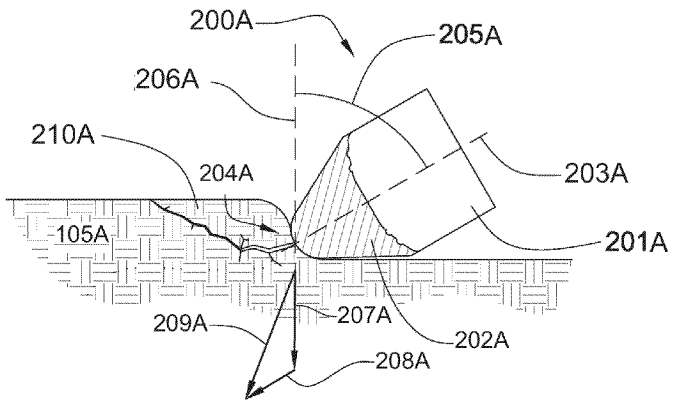
FIG. 2 is a cross-sectional diagram of an embodiment of a cutting element under a high weight-on-bit, low rotation per minute operating conditions.

FIG. 2 illustrates the a cutting element 200A at a 60 degree positive rake angle 205A. In this embodiment, the cutting element 200A may be adapted for attachment to a drill bit, the drill bit operating at a low rotation per minute (RPM) and having a high weight-on-bit (WOB). As a result, a vector force 207A produced by the WOB may be substantially large and downward. A slow rotational speed, or low RPM, may produce a vector force 208A substantially pointing in the direction of the central axis 203A of the cutting element 200A. Thus, the sum 209A of the vector forces 207A, 208A, may result in the cutting element 200A cutting a chip 210A from a formation 105A in a substantially wedge geometry as shown in FIG. 2. The formation 105A being drilled may comprise limestone, sandstone, granite, or combinations thereof. It is believed that angling the cutting element 200A at the given positive rake angle 205A may produce cuttings having a unit volume of 0.5 to 10 cubic centimeters. Further, 40 to 60 percent of the cuttings produced may have said range of volumes.

A vertical turret lathe (VTL) test was performed on a cutting element similar to the cutting element shown in FIG. 2. The VTL test was performed at Novatek International, Inc. located in Provo, Utah. A cutting element was oriented at a 60 degree positive rake angle adjacent a flat surface of a Sierra White Granite wheel having a six-foot diameter. Such formations may comprise a Mohs hardness of 5.5 to 7. The granite wheel rotated at 25 RPM while the cutting element was held constant at a 0.250 inch depth of cut into the granite formation during the test. The apex of the diamond working end had a radius of 0.094 inch. The diamond was produced by a high pressure and high temperature (HPHT) method using HPHT containers or can assemblies. U.S. patent application Ser. No. 11/469,229, which is incorporated by reference for all that it contains, discloses an improved assembly for HPHT processing that was used to produce the diamond working end used in this VTL test. In this assembly, a can with an opening contains a mixture comprising diamond powder, a substrate being positioned adjacent and above the mixture. A stop-off is positioned atop the substrate as well as first and second lid. A meltable sealant is positioned intermediate the second lid and a cap covering the opening. The assembly is heated to a cleansing temperature for a period of time. The assembly is then heated to a sealing temperature for another period of time.

It was discovered that approximately 40 to 60 percent of the granite chips produced during the test comprised a volume of 0.5 to 10 cubic centimeters. In the VTL test performed at Novatek International, Inc., it was discovered that when operating under these specified conditions, the wear on the cutting element was minimal. It may be beneficial to produce large chips while drilling downhole in order to improve the efficiency of the drilling operation. Degrading the downhole formation by forming large chips may require less energy than a large volume of fines. During a drilling operation, drilling fluid may be used to transport cuttings formed by the drill bit to the top of the wellbore. Producing larger chips may reduce the wear exerted on the drill string by reducing the abrasive surface area of the broken-up formation.

Figure 3:
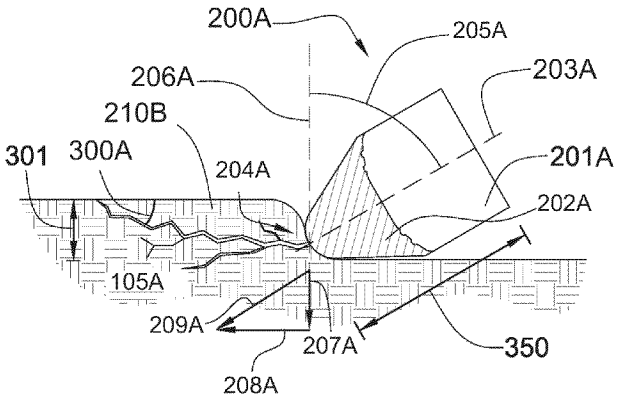
FIG. 3 is a cross-sectional diagram of the embodiment of a cutting element illustrated in FIG. 2 under a low weight-on-bit, high rotation per minute operating conditions.

Referring now to FIG. 3, a cutting element 200A may be positioned at a 60 degree positive rake angle 205A adjacent the formation 105B. In this embodiment, the cutting element 200A may be adapted for connection to a drill string operating at a high RPM and a low WOB. As a result, a downward force vector 207B produced by the WOB may have a relatively small magnitude while a force vector 208B produced by the RPM may be substantially horizontal. Although positioned at the same positive rake angle 205A, the cutting element 200A shown in FIG. 3 may produce a longer and narrower chip 210B than the chip 210A shown in FIG. 2 because of the different operating parameters, namely the WOB and RPM applied to the cutting element 200A in FIG. 3. The chip 210B may comprise a substantially wedge geometry tapering at a 5 to 30 degree incline angle 300A.

The cutting element 200A may comprise a length 350 of 0.250 to 1.50 inches. It may be beneficial to have a cutting element comprising a small length, or moment arm, such that the torque experienced during a drilling operation may be minimal and thereby extending the life of the cutting element. The cutting element 200A may also produce a 0.100 to 0.350 inch depth of cut 301 during a drilling operation. The depth of cut 301A may be dependent on the WOB and RPM specific to the drilling operation. The positive rake angle 205A may also vary the depth of cut 301. For example, a cutting element 200A operating at a low WOB and a high RPM, such as illustrated in FIG. 3, may produce a smaller depth of cut 301 than a depth of cut produced by a cutting element 200A operating at a high WOB and a low RPM as illustrated in FIG. 2. Also, a cutting element having a larger positive rake angle may produce a smaller depth of cut than a cutting element having a smaller positive rake angle.

Figure 5:
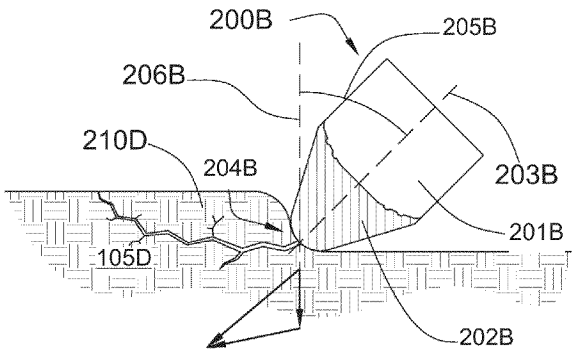
FIG. 5 is a cross-sectional diagram of the embodiment of a cutting element illustrated in FIG. 4 under a low weight-on-bit, high rotation per minute operating conditions.
Figure 4:
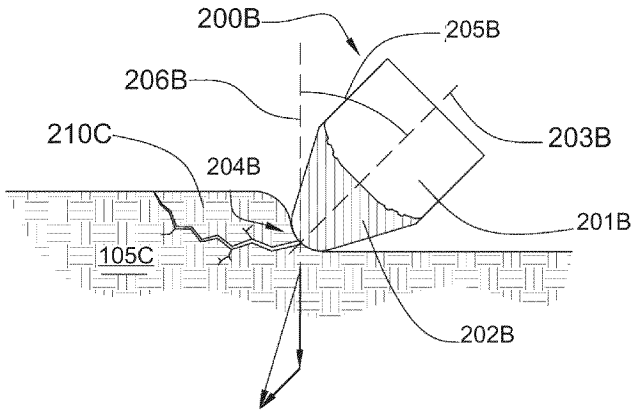
FIG. 4 is a cross-sectional diagram of another embodiment of a cutting element under a high weight-on-bit, low rotation per minute operating conditions.

A smaller rake angle 205B is shown for a cutting elements 200B operated under different conditions in FIGS. 4 and 5. In FIGS. 4 and 5, the cutting element 200B is positioned adjacent a formation 105C and 105D at a 45 degree positive rake angle 205B. In FIG. 4, the cutting element 200B may be operated at a high WOB and low RPM, whereas in FIG. 5 the cutting element 200B is operated with a low WOB and high RPM. Under the respective operating conditions, the chip 210C produced by the cutting element 200B in FIG. 4 may have a wedge geometry and may have a greater incline angle 300B than the incline angle 300C of the chip 210D shown in FIG. 5.

Figure 6:
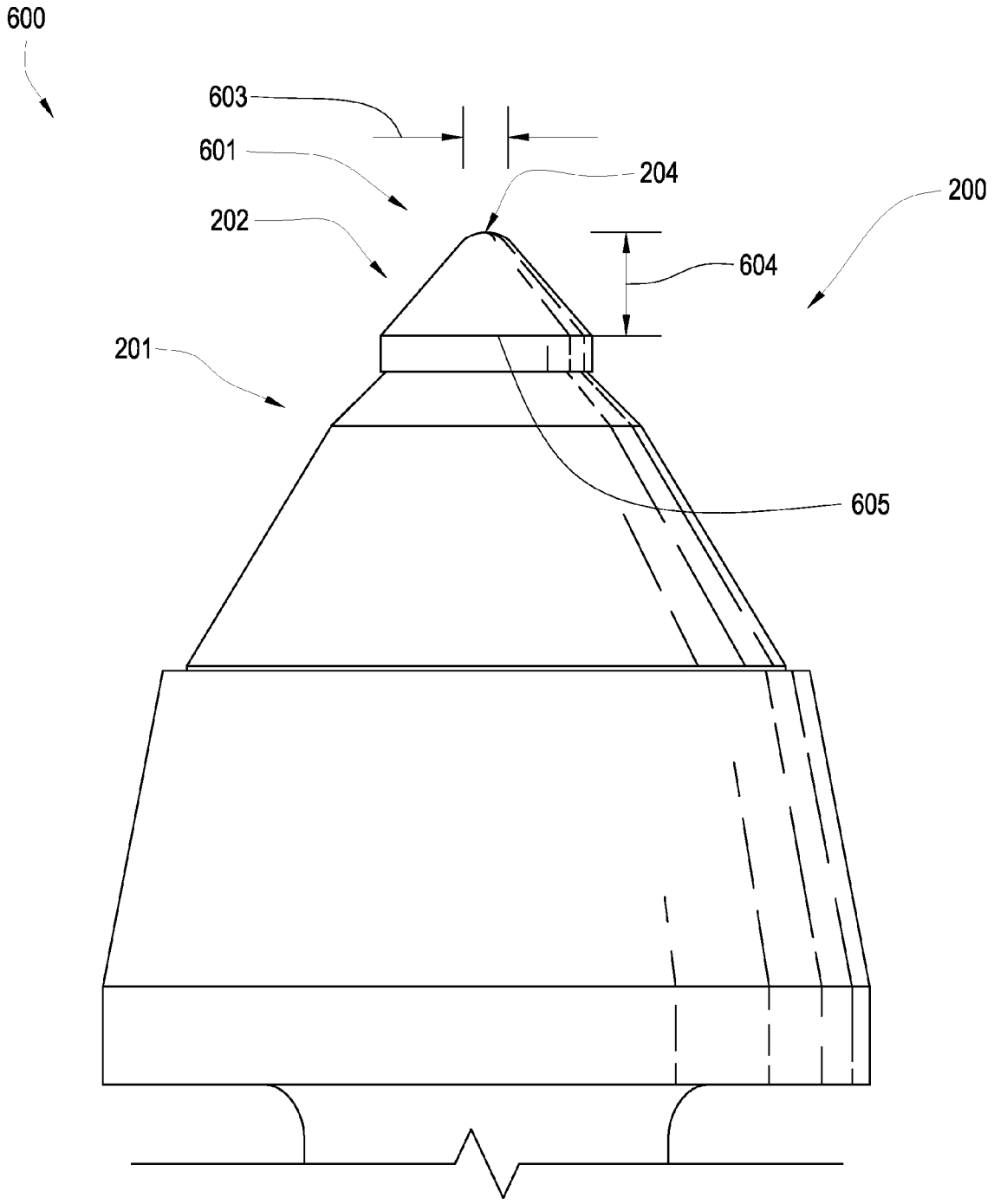
FIG. 6 is an orthogonal diagram of an embodiment of a high impact resistant tool.
Figure 19:
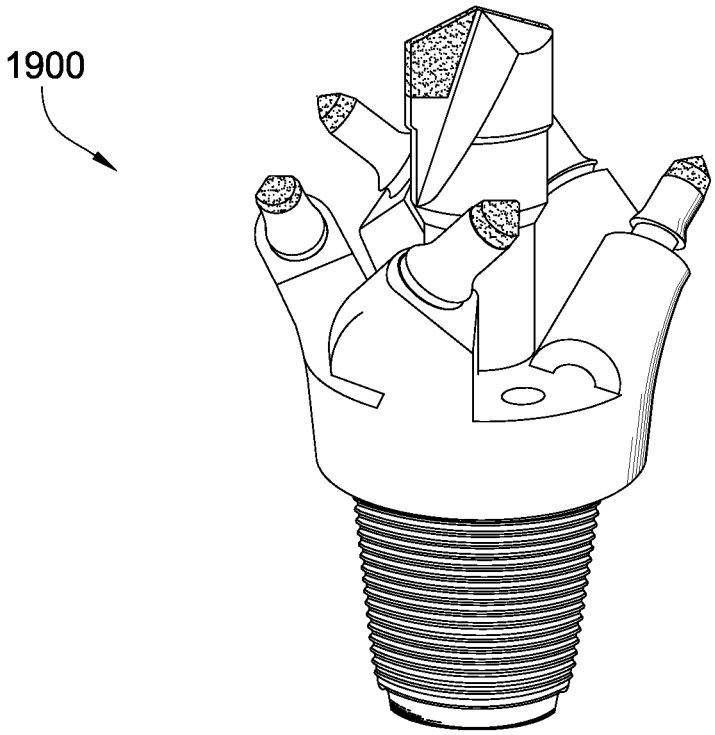
FIG. 19 is a perspective diagram of an embodiment of a drill bit.
Figure 20:
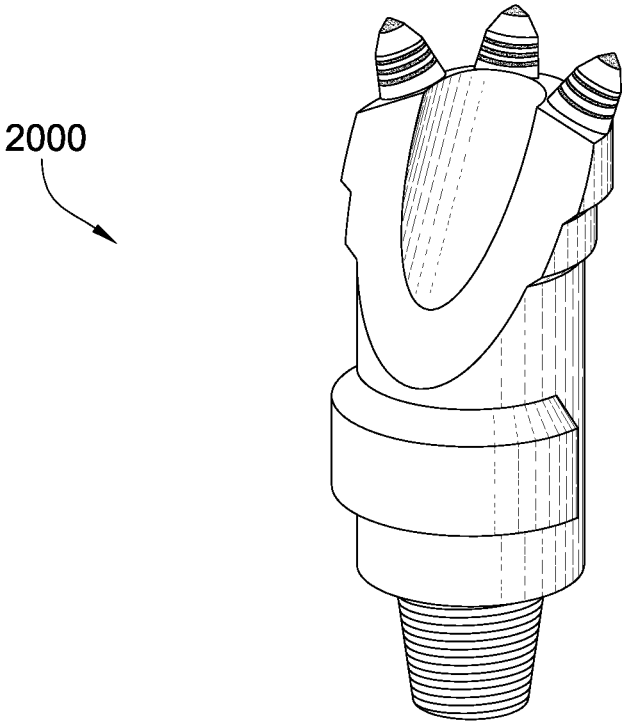
FIG. 20 is a perspective diagram of another embodiment of a drill bit.

Now referring to FIG. 6, the cutting element 200 may be incorporated into a high impact resistant tool 600, which is adapted for connection to some types of shear bits, such as the water well drill bit and horizontal drill bit shown in FIGS. 19 and 20. The cutting element 200 may have a diamond working end 202 attached to a carbide substrate 201, the diamond working end 202 having a pointed geometry 601. The pointed geometry 601 may comprise an apex 204 having a 0.050 to 0.200 inch radius 603. The diamond working end 202 may have a 0.090 to 0.500 inch thickness 604 from the apex 204 to a non-planar interface 605 between the diamond working end 202 and the carbide substrate 201. The diamond working end 202 may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. It is believed that a sharp thick geometry of the diamond working end 202 as shown in this embodiment may be able to withstand forces experienced during a drilling operation better than a diamond working end having a blunt geometry or a thin geometry.

Figure 7:
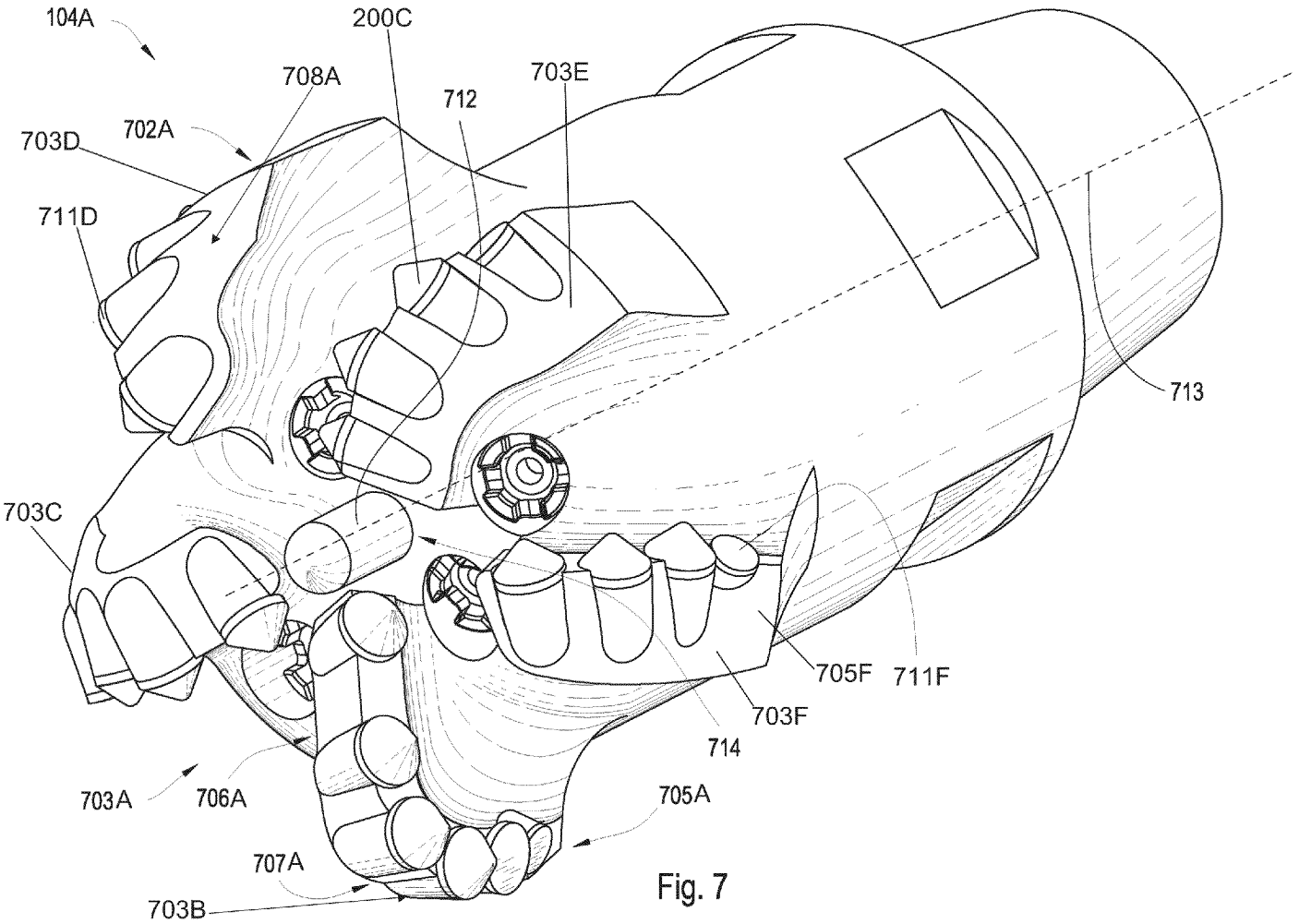
FIG. 7 is a perspective diagram of another embodiment of a drill bit.

In the embodiment of FIG. 7, a drill bit 104A may have a working face 702A having a plurality of blades 703A converging at a center of the working face 702A and diverging towards a gauge portion 705A of the working face 702A. At least one of the blades 703A may have at least one cutting element 200C with a carbide substrate bonded to a diamond working end with a pointed geometry. Cutting elements 200C may be arrayed along any portion of the blades 703B- F, including a cone portion 706A, a nose portion 707A, a flank portion 708A, and the gauge portion 705A. In this embodiment, at least one blade, such as blade 703F may have at least one shear cutting element 711F positioned along the gauge portion 705F of the blade 703F. In other embodiments, at least one shear cutting element 711D may be arrayed along any portion of the blade, such as blade 703D. The shear cutting elements and pointed cutting elements may be situated along the blade in any arrangement. In some embodiments, a jack element 712 coaxial with an axis of rotation 713 may extend out of an opening 714 of the working face 702A.

Figure 8:
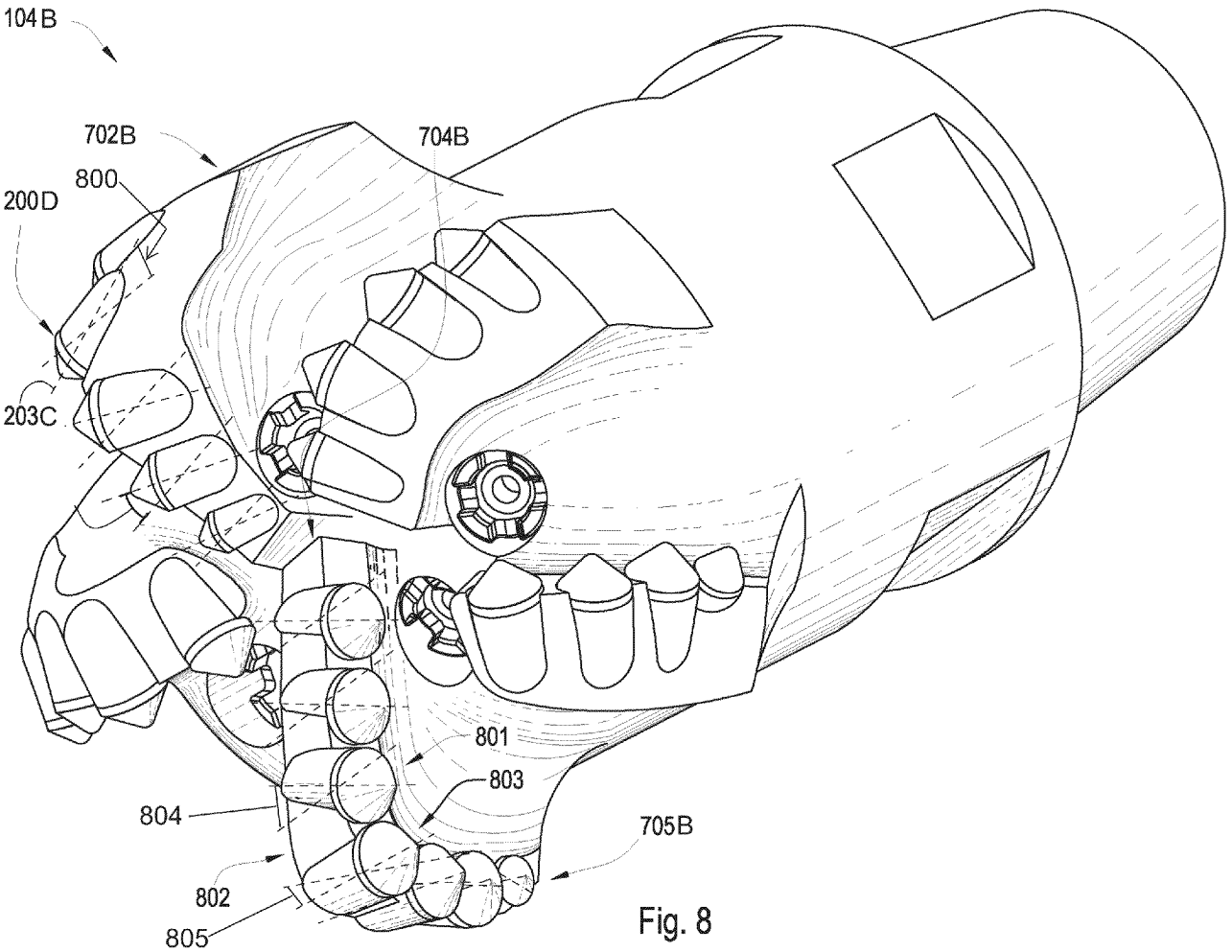
FIG. 8 is a perspective diagram of another embodiment of a drill bit.

Referring now to FIG. 8, the central axis 203C of the cutting element 200D may be positioned at an angle 800 relative to a cutting path formed by the working face 702B of the drill bit 104B during a downhole drilling operation. It may be beneficial to angle the cutting elements relative to the cutting path so that the cutting elements may break up the formation more efficiently by cutting the formation into larger chips. In the embodiment of FIG. 8, a cutting element 801 on a blade 802 may be oriented at an angle 804 different from the angle 805 of an adjacent cutting element 803 on the same blade 802. In this embodiment, cutting elements 801 on the blade 802 nearest the center 704B of the working face 702B of the drill bit 104B may be angled away from a center of the circular cutting path while cutting elements 803 nearer the gauge portion 705B of the working face 702B may be angled toward the center of the cutting path. This may be beneficial in that cuttings may be forced away from the center of the working face and thereby may be more easily carried to the top of the wellbore.

Figure 9:
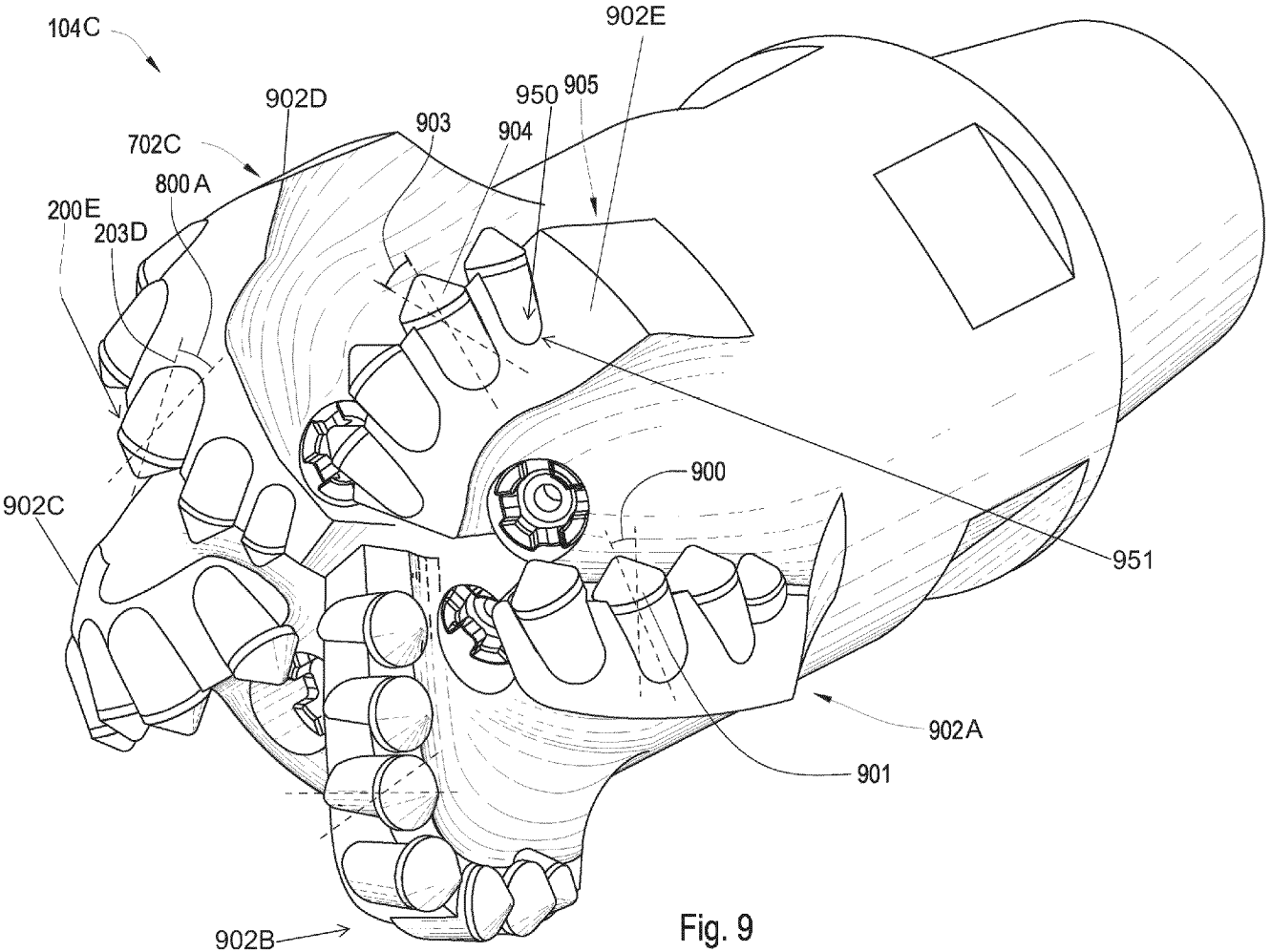
FIG. 9 is a perspective diagram of another embodiment of a drill bit.

Referring now to FIG. 9, the central axis 203D of the cutting element 200F may be positioned at an angle 800A relative to a cutting path formed by the working face 702C of the drill bit 104C during a downhole drilling operation. As noted above in the discussion of FIG. 8, it may be beneficial to angle the cutting elements relative to the cutting path so that the cutting elements may break up the formation more efficiently by cutting the formation into larger chips.

FIG. 9 shows an embodiment of a drill bit 104D in which an angle 900 of at least one cutting element 901 on a blade 902A is offset from an angle 903 of at least one cutting element 904 on an adjacent blade 905 . This orientation may be beneficial in that one blade having all its cutting elements at a common angle relative to a cutting path may offset cutting elements on another blade having another common angle. This may result in a more efficient drilling operation.

Figure 9A:
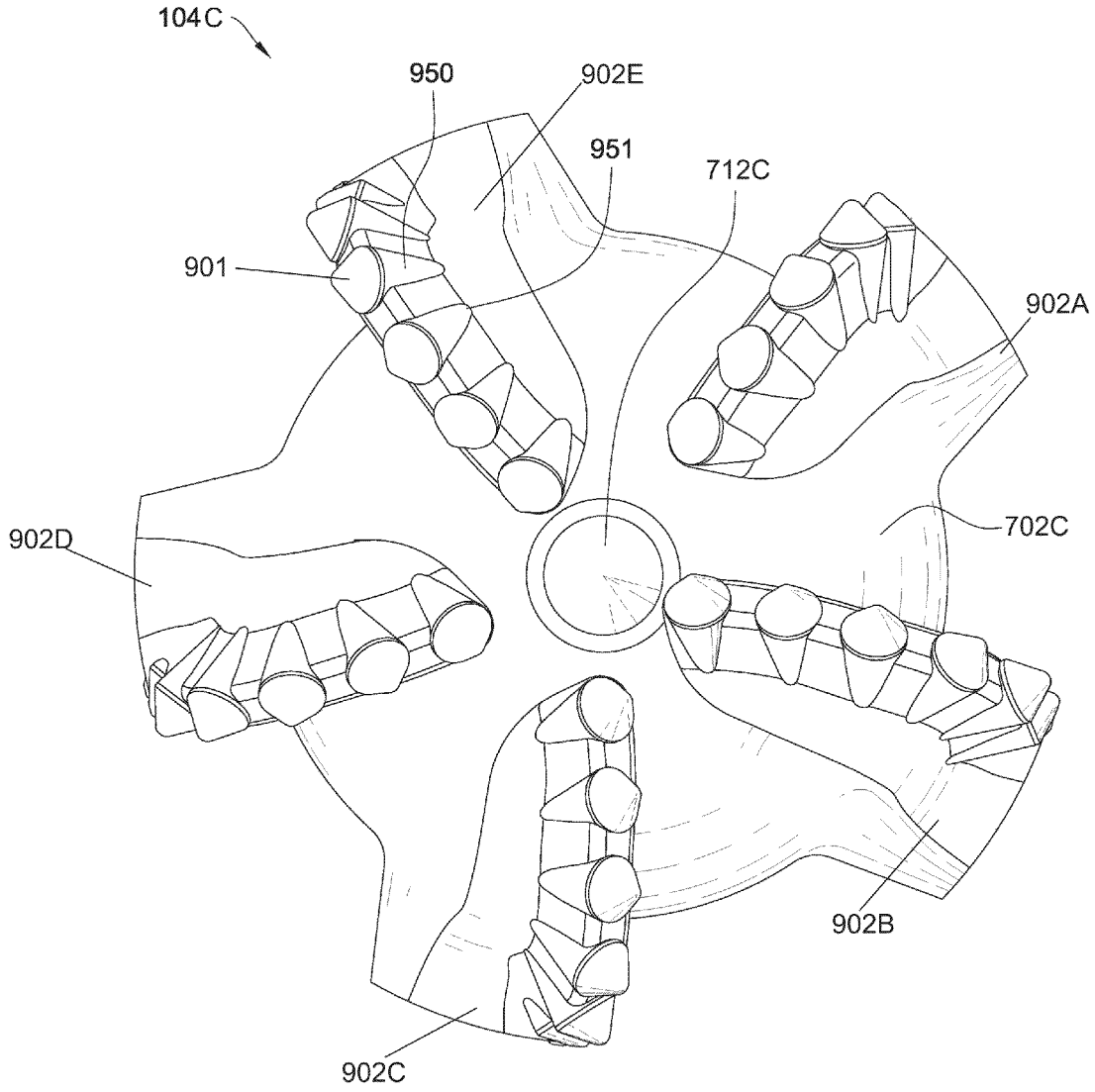
FIG. 9*a* is an orthogonal diagram of the embodiment of a drill bit illustrated in FIG. 9.

FIG. 9*a* discloses the drill bit 104C with a plurality of cutting elements like element 901 on blade 902A of the face 702C. At least one of the cutting elements is bonded to a tapered carbide backing 950 which is brazed into the blade 902E. In some embodiments the angle of the tapered carbide backing 950t may be between 5 and 30 degrees. In some embodiments, the blades 902A, 902B, 902C, 902D, and 902E surround at least ¾ of the circumference of the tapered carbide backing 950 proximate the cutting element. The combination of the taper of the tapered carbide backing 950 and the blades 902A, 902B, 902C, 902D, and 902E surrounding a majority of the circumference of the tapered carbide backing 950 may mechanically lock the tapered carbide backing 950 and, consequently, the cutting elements 901 in the blades 902A, 902B, 902C, 902D, and 902E. In some embodiments, a proximal end 951 of the tapered carbide backing 950 may be situated in a pocket such that when a force is applied to the cutting element 901 the force may be transferred through the tapered carbide backing 950 and generate a hoop tension in the blades 902A, 902B, 902C, 902D, and 902E. A jack element 712C may protrude out of the working face 702C such that an unsupported distal end of the jack element 712C may protrude between 0.5 to 1.5 inches. In some embodiments, a portion of the jack element 712C supported by the bit body may be greater than an unsupported portion. In some embodiments, the bit body may comprise steel, matrix, carbide, or combinations thereof. In some embodiments, the jack element 712C may be brazed directly into a pocket formed in the bit body or it may be press fit into the bit body.

Figure 10:
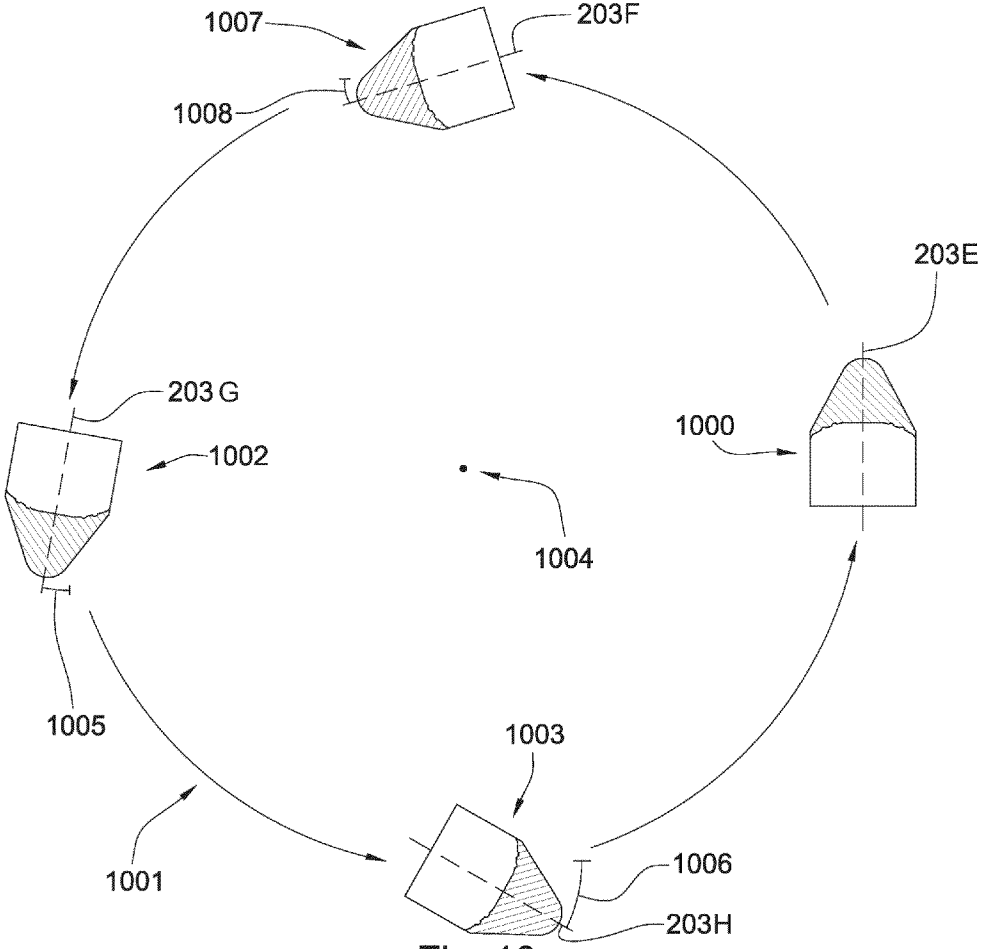
FIG. 10 is a representation of an embodiment a pattern of cutting element.

Referring now to FIG. 10, the central axis 203E of a cutting element 1000 may run tangent to a cutting path 1001 formed by the working face of the drill bit during a downhole drilling operation. The central axis 203F, 203G, and 203H of other cutting elements 1007, 1002, 1003, respectively, may be angled away from a center 1004 of the cutting path 1001. The central axis 203G of the cutting element 1002 may form a smaller angle 1005 with the cutting path 1001 than an angle 1006 formed by the central axis 203H and the cutting path 1001 of the cutting element 1003. In other embodiments, the central axis 203F of a cutting element 1007 may form an angle 1008 with the cutting path 1001 such that the cutting element 1007 angles towards the center 1004.

Figures 11, 12, 13, 14, 15, 16, 17, 18:
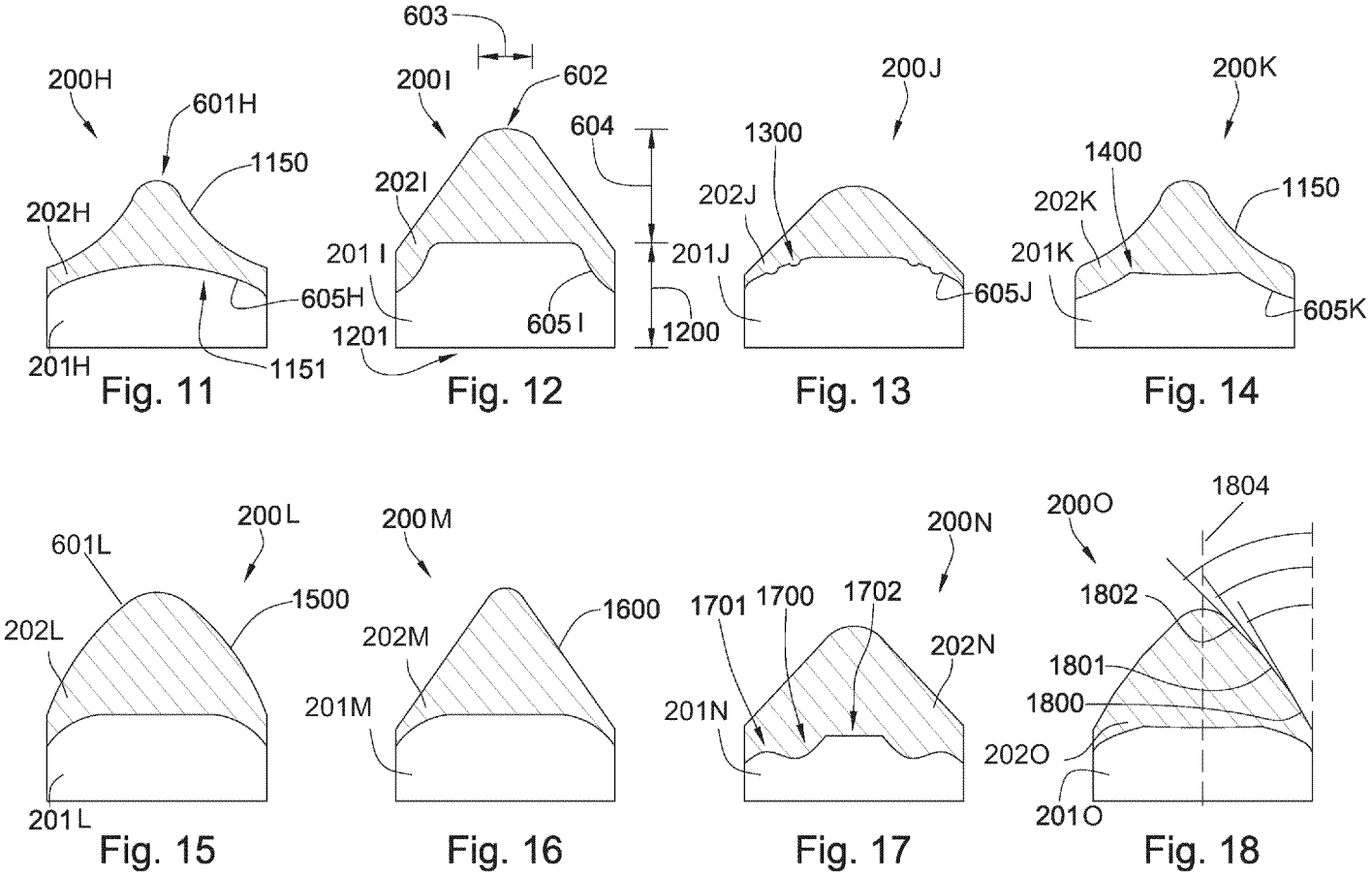
FIG. 11 is a cross-sectional diagram of another embodiment of a cutting element.
FIG. 12 is a cross-sectional diagram of another embodiment of a cutting element.
FIG. 13 is a cross-sectional diagram of another embodiment of a cutting element.
FIG. 14 is a cross-sectional diagram of another embodiment of a cutting element.
FIG. 15 is a cross-sectional diagram of another embodiment of a cutting element.
FIG. 16 is a cross-sectional diagram of another embodiment of a cutting element.
FIG. 17 is a cross-sectional diagram of another embodiment of a cutting element.
FIG. 18 is a cross-sectional diagram of another embodiment of a cutting element.

FIGS. 11 through 18 show various embodiments of a cutting element 200H-O with a diamond working end 202H-O bonded to a carbide substrate 201H-O; the diamond working ends 202H-O each have a tapered surface and a pointed geometry. FIG. 11 illustrates a pointed geometry 601H having a concave side 1150 and a continuous convex geometry 1151 at an interface 605H between the substrate 201H and the diamond working end 202H. FIG. 12 comprises an embodiment of a diamond working end 202I having a thickness 604 from the apex 602 to a non-planar interface 605I, while still maintaining a radius 603 of 0.050 to 0.200 inch. The diamond working end 202I may comprise a thickness 604 of 0.050 to 0.500 inch. The carbide substrate 201I may comprise a thickness 1200 of 0.200 to 1 inch from a base 1201 of the carbide substrate 201I to the non-planar interface 605I. FIG. 13 illustrates grooves 1300 formed in the carbide substrate 201J. It is believed that the grooves 1300 may help to increase the strength of the cutting element 200J at an interface 605J between the diamond working end 202J and the carbide substrate 201J. FIG. 14 illustrates a slightly concave geometry 1400 at a non-planar interface 605K and a concave side 1150 to the diamond working end 202K. FIG. 15 discloses a slightly convex side 1500 of the pointed geometry 601L of the diamond working end 202L while still maintaining a 0.050 to 0.200 inch radius. FIG. 16 discloses the diamond working end 202M has a flat sided pointed geometry 1600. FIG. 17 discloses a concave portion 1700 and a convex portion 1701 of the carbide substrate 201N with a generally flatted central portion 1702. In the embodiment of FIG. 18, the diamond working end 202O may have a convex surface comprising different general angles at a lower portion 1800, a middle portion 1801, and an upper portion 1802 with respect to the central axis 1804 of the cutting element 200O. The lower portion 1800 of the side surface may be angled at substantially 25 to 33 degrees from the central axis 1804; the middle portion 1801, which may make up a majority of the convex surface, may be angled at substantially 33 to 40 degrees from the central axis 1804; and the upper portion 1802 of the convex surface may be angled at substantially 40 to 50 degrees from the central axis 1804.

FIGS. 19 and 20 disclose various wear applications that may be incorporated with the present invention. FIG. 19 is a drill bit 1900 typically used in water well drilling. FIG. 20 is a drill bit 2000 typically used in subterranean, horizontal drilling. These bits 1900, 2000, and other bits, may be consistent with the present invention.

Figure 21:
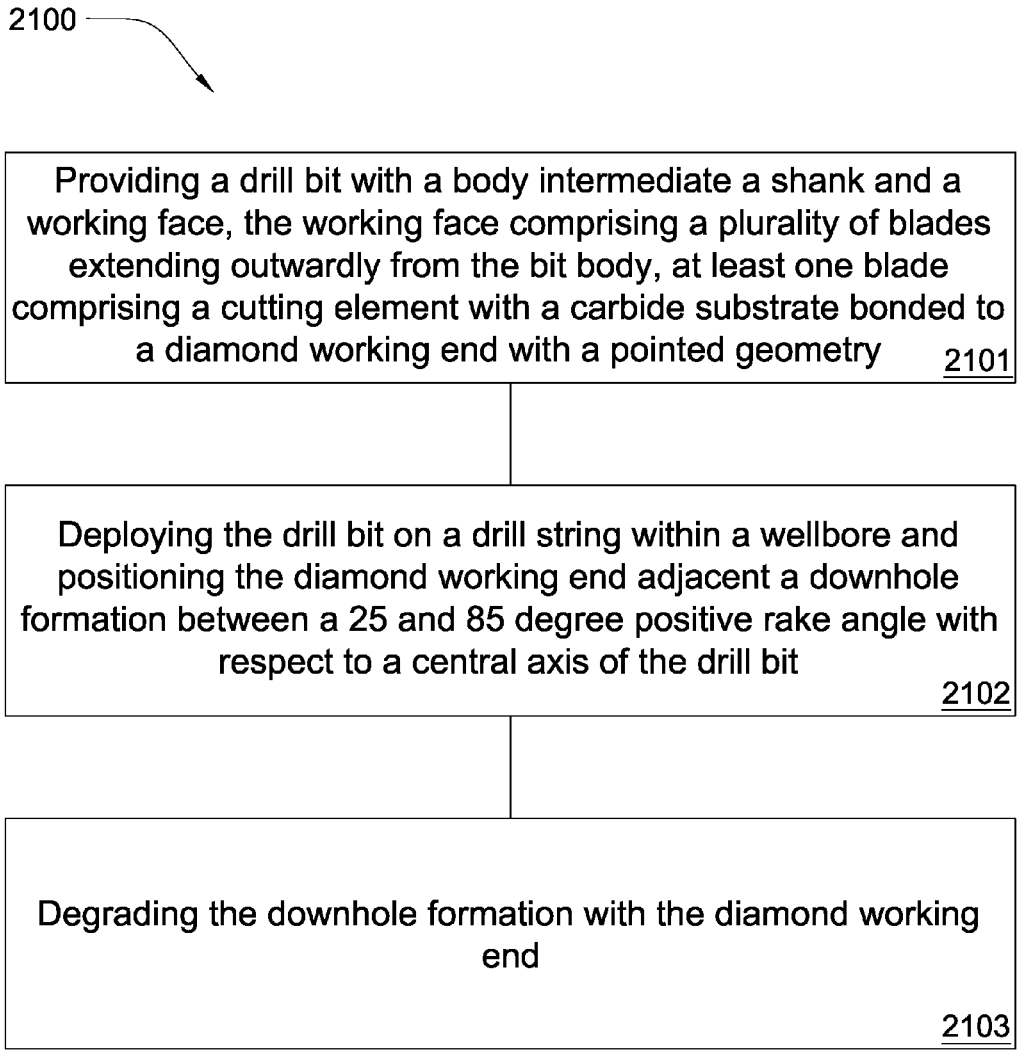
FIG. 21 is a diagram of an embodiment of a method for forming a wellbore.

FIG. 21 is a method 2100 of an embodiment for forming a wellbore. The method 2100 may include providing 2101 a drill bit with a body intermediate a shank and a working face, the working face comprising a plurality of blades extending outwardly from the bit body, at least one blade comprising a cutting element with a carbide substrate bonded to a diamond working end with a pointed geometry. The method 2100 also includes deploying 2102 the drill bit on a drill string within a wellbore and positioning the diamond working end adjacent a downhole formation between a 25 and 85 degree positive rake angle with respect to a central axis of the drill bit. The method 2100 further includes degrading 2103 the downhole formation with the diamond working end. 40 to 60 percent of the cuttings produced by the cutting element may have a volume of 0.5 to 10 cubic centimeters.

Whereas the present invention has been described in particular relation to the drawings attached hereto, it should be understood that other and further modifications apart from those shown or suggested herein, may be made within the scope and spirit of the present invention.

What is claimed is:

1. A drill bit for drilling into a formation, said drill bit comprising:

a shank;

a body having opposite ends with one of said opposite ends connected to said shank;

a working face at the other of said opposite ends, said working face having a center and a perimeter;

the working face comprising a plurality of blades extending outwardly there from from proximate a bit center to a gauge portion proximate said perimeter of said working face, at least one blade having a cone, nose, flank, and gauge portion; and at least one cutting element attached to each blade of said plurality of blades, each of said cutting elements having a carbide substrate bonded to a diamond working end, said diamond working end being formed to have a pointed end having a radius ranging from 0.050 inch to 0.200 inch, and each of said cutting elements having a central axis oriented between a 25 degree and an 85 degree positive rake angle.

2. The drill bit of claim 1, wherein said formation is rock-like, and wherein said positive rake angle is selected for said cutting elements to produce cuttings from said formation, 40 to 60 percent of said cuttings each having a unit volume of 0.5 to 10 cubic centimeters.

3. The drill bit of claim 2, wherein said cuttings formed by said cutting elements have a substantially wedge geometry tapering at a 5 to 30 degree angle.

4. The drill bit of claim 1, wherein said central axis is oriented between a 35 degree and 50 degree positive rake angle.

5. The drill bit of claim 1, wherein said carbide substrate and said diamond working end have a non-planar interface therebetween, and wherein said diamond working end has a thickness from 0.090 inch to 0.500 inch from said pointed end to said non-planar interface.

6. The drill bit of claim 1, wherein said cutting elements are positioned at a rake angle to cause a 0.100 inch to 0.350 inch depth of cut during a drilling operation.

7. The drill bit of claim 1, wherein said central axis of each of said plurality of cutting elements is tangent to a cutting path formed by said working face of the drill bit.

8. The drill bit of claim 1, wherein said body has an axis of rotation and wherein said body has an opening formed in said working face and wherein said body includes a jack element coaxial with said axis of rotation and positioned to extend out of said opening formed in said working face.

9. A method for forming a wellbore, said method comprising:

providing a drill bit having a shank for connection to a drill string for rotating said shank, a body having opposite ends with one of said opposite ends connected to said shank, a working face at the other of said opposite ends, the working face having a center and a perimeter, and comprising a plurality of blades extending outwardly therefrom from proximate a bit center to a gauge portion to engage said wellbore, at least one blade having a cone, nose, flank, and gauge portion, and at least one cutting element attached to each blade of said plurality of blades at between a 25 degree and an 85 degree positive rake angle, each of said cutting elements having a carbide substrate bonded to a diamond working end, said diamond working end being formed to have a pointed end having a radius ranging from 0.050 inch to 0.200 inch to engage a formation through which said wellbore travels and;

deploying said drill bit on said drill string within said wellbore and positioning said drill bit so that said diamond working end engages said formation; and rotating said drill string and said drill bit to degrade said formation with said diamond working end of said cutting element.

10. The method of claim 9, wherein said drill bit rotates at 90 to 150 revolutions per minute.

11. The method of claim 9, wherein said rake angle is selected to produce cuttings of said formation when degrading said formation, wherein 40 to 60 percent of said cuttings each have a volume of 0.5 to 10 cubic centimeters.

12. A drill bit for drilling into a formation, said drill bit comprising:

a shank for connection to a drill string;

a body having a first end and a second end opposite said first end, said first end being connected to said shank;

a working face at said second end;

the working face comprising a plurality of blades extending outwardly there from a bit center to a gauge portion proximate the perimeter of the working face, at least one blade having a cone, nose, flank, and gauge portion; and at least one cutting element attached to each blade of said plurality of blades and positioned to engage said formation, each of said at least one cutting elements having a carbide substrate bonded to a diamond working end at a non-planar interface, said diamond working end being formed to have a pointed end having a radius ranging from 0.050 inch to 0.200 inch and said cutting element having a central axis oriented between a 25 degree and an 85 degree positive rake angle.

13. The drill bit of claim 12 wherein said central axis is angled relative to a cutting path of each of said at least one cutting elements.

14. The drill bit of claim 13 wherein said central axis is angled towards a center of said working face.

* * * * *